US006053120A

United States Patent [19]

Shields

[11] Patent Number: 6,053,120

[45] Date of Patent: Apr. 25, 2000

[54] SHIP CONSTRUCTION USING MOVABLE PLASTIC INTERIOR WALLS

[75] Inventor: Steven E. Shields, San Diego, Calif.

[73] Assignee: Raytheon Company, Lexington, Mass.

[21] Appl. No.: 09/124,402

[22] Filed: Jul. 29, 1998

[51] Int. Cl.[7] ..... B63B 3/68

[52] U.S. Cl. ..... 114/65 R; 114/71; 114/78

[58] Field of Search ..... 114/65 R, 78, 114/71

[56] References Cited

U.S. PATENT DOCUMENTS

| | | | |
|---|---|---|---|
| 2,079,635 | 5/1937 | Sharp | 114/71 |
| 2,179,820 | 11/1939 | Hunter . | |
| 3,274,741 | 9/1966 | Neagle . | |
| 3,812,808 | 5/1974 | Shirota et al. | 114/78 |

FOREIGN PATENT DOCUMENTS

| | | | |
|---|---|---|---|
| 916 807 | 12/1946 | France . | |
| 2 248 190 | 10/1974 | France . | |
| 60-236891 | 11/1985 | Japan | 114/71 |
| 63-103786 | 5/1988 | Japan | 114/71 |
| 895791 | 1/1982 | U.S.S.R. | 114/78 |
| 856801 | 12/1960 | United Kingdom | 114/78 |
| 1 389 705 | 6/1972 | United Kingdom . | |
| 1 350 411 | 4/1974 | United Kingdom . | |
| 91/11323 | 8/1991 | WIPO . | |

*Primary Examiner*—Sherman Basinger
*Attorney, Agent, or Firm*—Colin M. Raufer; Leonard A. Alkov; Glenn H. Lenzen, Jr.

[57] ABSTRACT

A ship is constructed of a skeleton, including a hull, horizontal decks, and vertical support posts, all permanently joined together. At least some of the interior walls are made of a composite material of reinforcement embedded in a plastic matrix. These non-structural interior walls are semi-permanently attached to the skeleton with attachments, so that they may be readily rearranged to reconfigure the interior of the ship. The majority of the apparatus and infrastructure of the ship is affixed to the skeleton but not to the non-structural walls.

20 Claims, 3 Drawing Sheets

FIG.4
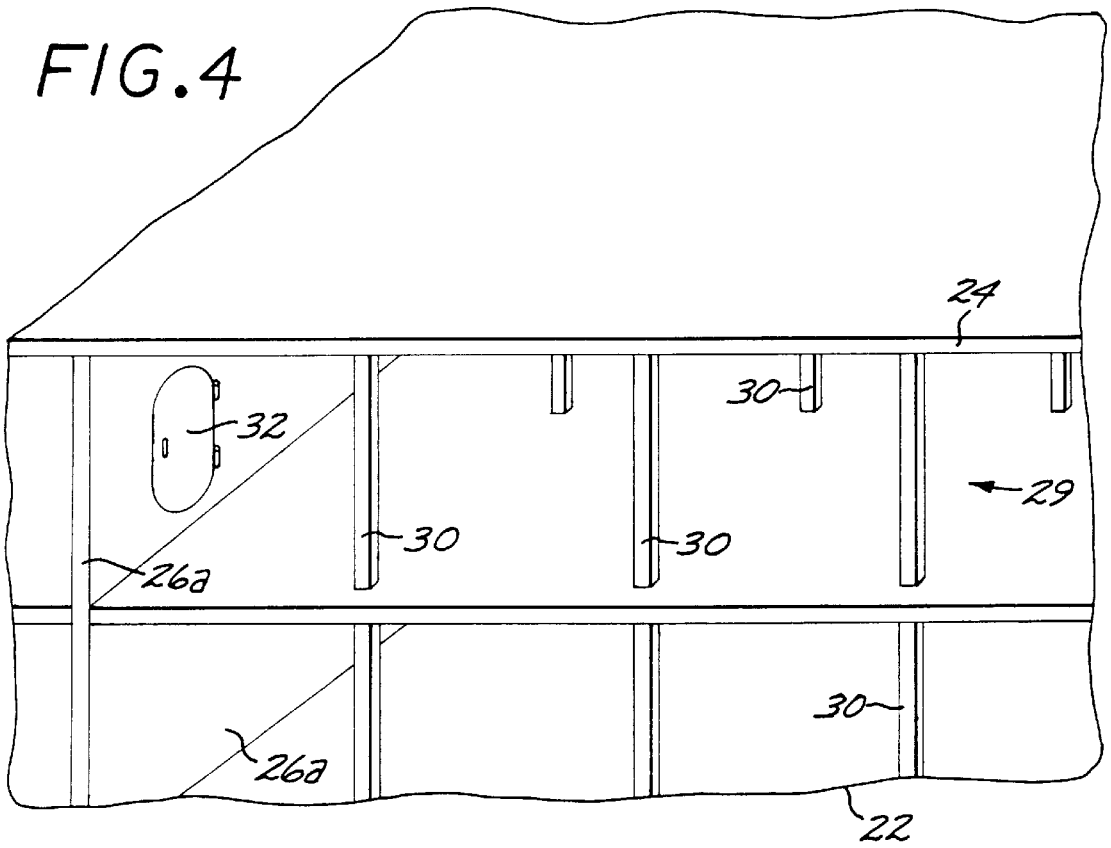
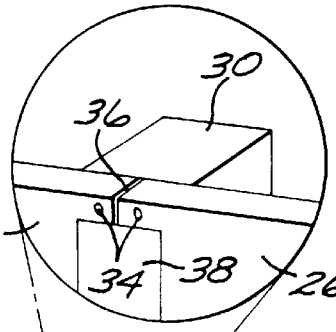
FIG.5B
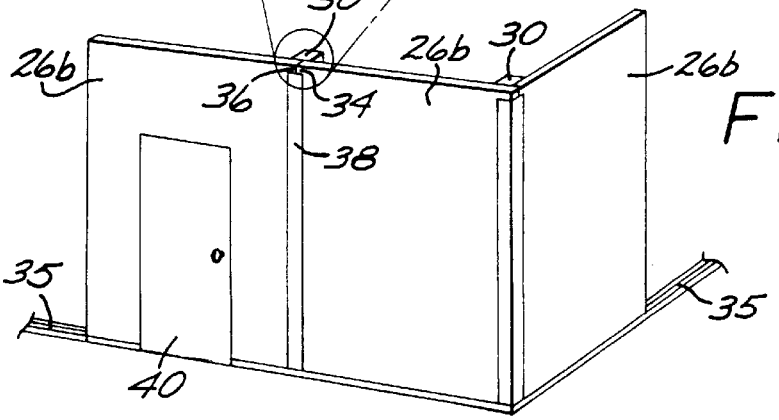
FIG.5A

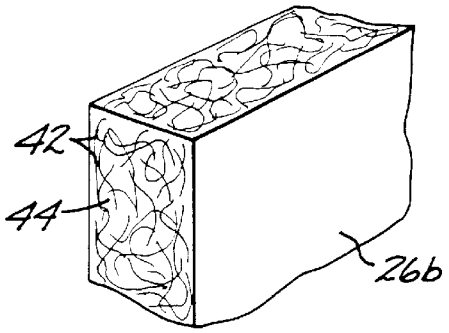
FIG. 6
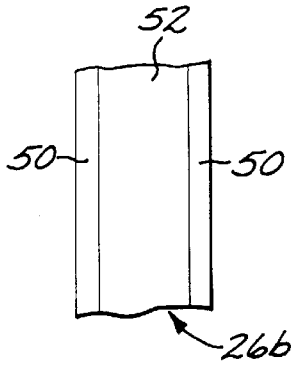
FIG. 8
FIG. 7
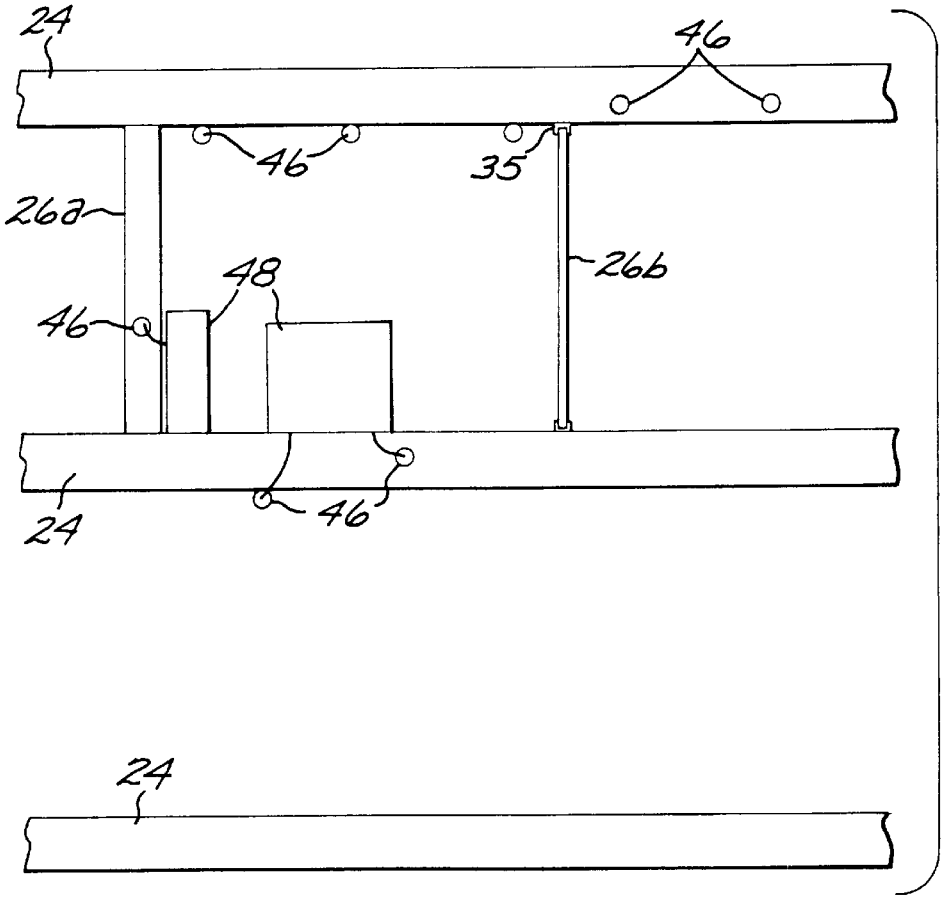

SHIP CONSTRUCTION USING MOVABLE PLASTIC INTERIOR WALLS

BACKGROUND OF THE INVENTION

This invention relates to the construction of ships and, more particularly, to a ship structure that increases the flexibility of utilization of the ship.

Large ships have a structure including a hull, and a number of internal horizontal decks within the hull and extending above the hull. Vertical walls or bulkheads extend between the decks to support the higher decks, to provide rigidity to the structure, and to divide each deck into compartments. There are doors through the walls, and the doors at selected bulkheads are made watertight so as to divide the interior of the ship into a large number of watertight spaces. This structure is typically made of steel welded into a rigid structure. In some cases, parts of the structure may be made of plastic or other metals such as aluminum, but in these cases the same structural approach is used so that the structure is defined.

Such a ship structure is operable and satisfactory for many types of ships and for many types of applications. In other instances, the inventor has observed that the existing structure provides far more strength and rigidity than required. Additionally, this existing ship construction limits the flexibility of utilization of the vessel. Once the shape and size of each compartment is defined during the original construction, for example, they cannot be readily altered even if the ship is used for many years and its mission changes over time. If the internal arrangement of the space is to be changed, a major and costly refitting is required that typically consumes many months and removes the ship from service during that time.

There is a need for an improved approach to the design and construction of ships that overcomes this inflexibility of utilization. The present invention fulfills this need, and further provides related advantages.

SUMMARY OF THE INVENTION

The present approach provides an approach to ship design that achieves improved flexibility of utilization without sacrificing the basic strength and seaworthiness of the vessel. The approach of the invention significantly reduces maintenance requirements of the ship and improves its internal appearance. The weight of the ship is reduced, improving its fuel efficiency. The present approach also improves internal communication within the ship. Design changes in the provision of services and infrastructure support within the interior of the vessel are required in the present approach, but these changes are readily implemented and do not adversely affect the use of the ship.

In accordance with the invention, a ship comprises a skeleton, preferably made of steel, having a hull, a horizontally disposed deck permanently joined to the hull, and a plurality of vertically disposed structural support posts permanently joined to the deck. In most cases, there are a plurality of decks, with support posts extending between horizontally adjacent decks. Typically, structural walls extend between the decks. There are also a plurality of non-structural wall segments, each of the wall segments comprising a plastic-containing material such as a composite material of reinforcement fibers embedded in a plastic matrix. There are a plurality of attachments of the non-structural wall segments to the skeleton.

The internal layout of a ship according to the present invention includes the steel skeleton of a hull, horizontal decks, and vertical support posts, and usually also includes at least some rigid structural walls extending between the decks. Non-structural walls further divide the interior space. These non-structural walls are not watertight, and do not readily serve to carry conduits through the ship. The non-structural walls are attached to the skeleton by any operable means, such as fasteners to the support posts and tracks in the ceilings and floors.

The non-structural walls are readily moved to redefine the shapes and sizes of the compartments. They may be provided with insulation to reduce noise conveyed between the compartments, and their nonmetallic construction tends to produce less noise and to damp out noise produced elsewhere. The non-structural plastic or composite walls are virtually maintenance free, inasmuch as their color extends throughout the thickness and does not require painting. The non-structural walls are also highly resistant to scratches and other damage. The nonmetallic plastic or composite walls are corrosion free as well.

In existing ship construction, onboard apparatus and infrastructure elements such as cables, pipes, and the like may be affixed to the walls or to the floors. In the approach of the invention, the movable non-structural walls are relatively fragile and cannot support heavy apparatus or infrastructure elements. These items are therefore supported from the skeleton, ordinarily the floor of each deck. Power and other connectors are run through the deck or through overhead conduits where good access is required, or through the structural walls.

The present approach does not contemplate that all internal walls of the ship will be of the plastic construction, for several reasons. Some spaces, such as engine rooms, and magazines and classified areas on warships, will always require a more-secure isolation than possible when the space is defined by a non-structural wall. The non-structural walls are not watertight, and only conventional structural walls can provide the watertight structure that reduces the likelihood of sinking of the vessel. However, in most current cases the structural walls inflexibly divide the interior of the vessel into compartments that are so small that each compartment need not be independently watertight. In fact, many naval vessels do not provide that each compartment be watertight even where the walls are structural and made of steel. Only occasional watertight bulkheads are used, and this same approach is followed in a vessel made according to the present approach. However, instead of the non-watertight walls being made of steel or wood or some other permanent construction, in the present approach the walls are made of plastic such as a reinforced plastic and are movable.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 4 is a schematic perspective view of the internal portion of the skeleton structure of the ship construction of FIG. 3;

FIG. 5A is a schematic perspective illustration of the support and joining of non-structural wall segments, and FIG. 5B is a detail of FIG. 5A;

FIG. 6 is an enlarged perspective view of a non-structural wall, sectioned on two faces to illustrate the internal structure of the non-structural wall;

FIG. 7 is a detail of the structure of FIG. 3, illustrating the placement of apparatus and infrastructure; and FIG. 8 is a sectional view of a panel with insulation therein.

DETAILED DESCRIPTION OF THE INVENTION

Figure 1:
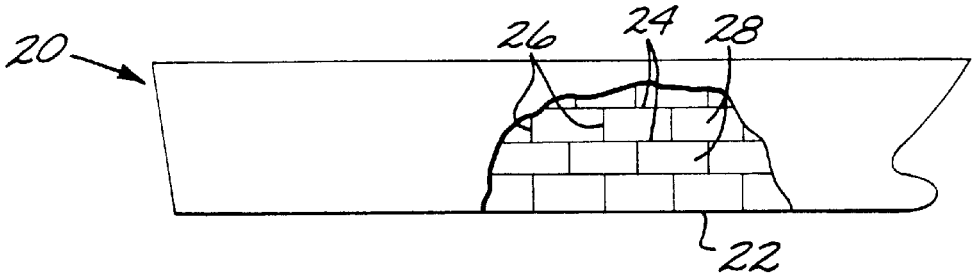
FIG. 1 is a schematic side elevational view of a ship.

FIG. 1 illustrates the general construction of a ship 20. The ship 20 includes a hull 22, at least one and typically many generally horizontally oriented decks 24, and at least one, and typically many, generally vertical walls 26 (also termed "bulkheads") extending between the decks 24. The horizontal decks 24 and the vertical walls 26 divide the interior of the ship into many compartments 28.

Figure 2:
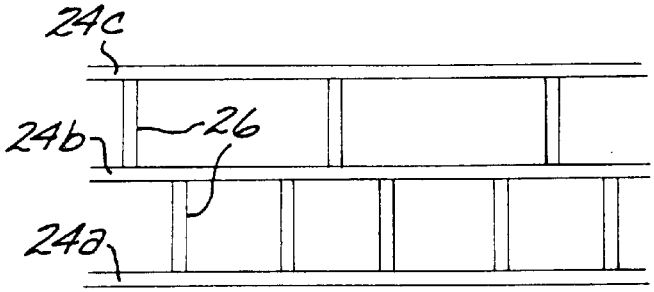
FIG. 2 PRIOR ART
FIG. 2 is a detail of an internal portion of the ship of FIG. 1, where the ship is made of a conventional construction.

FIG. 2 shows a typical prior construction. Three decks 24*a*, 24*b*, and 24*c* are shown, with walls 26*a* extending between the decks. The walls 26*a* are all structural walls, made of steel and serving to bear a portion of the overlying loads.

Figure 3:
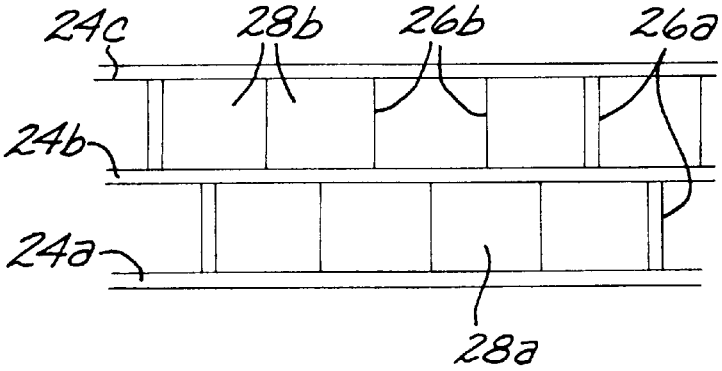
FIG. 3 is a detail of an internal portion of the ship of FIG. 1, where the ship is made according to the present approach.

FIGS. 3–5 illustrate a construction according to the present invention. Referring to FIG. 3, the ship 20 includes the same decks 24*a*, 24*b*, and 24*c*. Some structural walls 26*a* extend between the decks, defining watertight compartments 28*a*. Additionally, some non-structural wall segments 26*b* extend between the decks, further dividing the watertight compartments 28*a* into non-watertight compartments 28*b*. (In FIGS. 2 and 3, a structural vertical wall 26*a* is denoted by double lines, and a non-structural vertical wall segment 26*b* is denoted by a single line.)

The structure according to the present invention may be conveniently described as a skeleton 29 with non-structural wall segments attached to the skeleton. FIG. 4 depicts the skeleton 29, which is preferably made of steel with all of the elements of FIG. 4 rigidly welded to each other. The skeleton 29 includes the hull 22, one or more horizontal decks 24, and one or more structural walls 26*a*. Additionally, the skeleton 29 includes a series of structural support posts 30 extending between the hull 22 and the lowest deck 24, and between the decks 24. These support posts 30 serve two primary functions: they support loads imposed from the overlying decks, and they support the non-structural wall segments in a manner to be described in relation to FIGS. 5A–B. Watertight doors 32 may extend through the structural walls 26*a*. This type of wall-and-post construction is not found in conventional vessels.

Referring to FIGS. 5A and 5B, the non-structural wall segments 26*b* are attached to the skeleton 29 with any operable attachments 34. The attachments 34 permit the wall segments 26*b* to be attached to the skeleton and then later disassembled by removal of the attachments. The attachments 34 may be, for example, clips, screws, or bolts that extend through the non-structural wall segments 26*b* and into or through the skeletal elements such as the structural walls 26*a*, the decks 24, or the support posts 30. Most preferably, the primary attachments of the non-structural wall segments 26*b* to the skeleton 29 are made to the support posts 30, as shown in FIGS. 5A and 5B. To hold the non-structural wall segments 30 straight and rigid along their entire lengths contacting the floors and ceilings, tracks 35 may be provided. A floor track 35 is shown in FIG. 5A, and a similar ceiling track may be present. The bottom and top edges of the non-structural wall segments 26*b* fit into the tracks, and the vertical edges are attached to the support posts 30 by the attachments 34. Equivalently for the present purposes but less desirably, other fasteners could be provided to attach the bottom and top edges of the non-structural wall segments 26*b* to the floor and ceiling, respectively.

To allow for easy assembly and disassembly of the non-structural wall segments 26*b* to the skeleton and to permit thermal expansion of the non-structural wall segments 26*b*, there is typically a small gap 36 provided between the ends of the non-structural wall segments 26*b* when attached to the skeleton 29. To cover this gap 36 and the attachments 34, and to generally improve the appearance of the non-structural wall segments 26*b*, vertically extending cover strips 38 are provided. The cover strips 38 fit into the gap with an interference fit and are sufficiently wide to cover the gap 36 and the attachments 34.

In the embodiment of FIGS. 5A and 5B, the non-structural wall segments 26*b* are provided on only one side of the support posts 30, leaving the support posts exposed in the adjacent compartment. This arrangement would be acceptable for many military and cargo applications. Where the non-structural wall segments 26*b* define passenger compartments, as on a cruise ship, comparable wall structures may be provided on the other side of each support post 30, so that the support posts are not exposed to view.

Doors may be placed in the non-structural wall segments 26*b*,as seen in FIG. 5A. These doors are not watertight.

FIGS. 5A and 5B illustrate an important advantage of the invention. The non-structural wall segments 26*b* may be quickly disassembled from one compartment configuration by removing the cover strips 38 and the attachments 34. They may be reassembled in another compartment configuration by attaching them to the support posts in another arrangement with the attachments 34, and then re-applying the cover strips 38. No costly refitting in a shipyard is required.

The non-structural wall segments 26*a* are in the form of panels of plastic materials. FIG. 6 illustrates one such panel which is sectioned along its visible edges to show the preferred interior construction. The panel is a reinforced composite material having reinforcing fibers 42 embedded in a plastic matrix such as an epoxy. Such panels may be formed by known fabrication techniques such as collation of prepreg laminates or resin transfer molding. Non-reinforced panels may be used in some situations, but their rigidity is much lower than that of the reinforced panels.

FIG. 7 shows the approach used with the present construction for furnishing the interior of the compartments and for providing infrastructure. Infrastructure conduits 46 are provided to convey fluids (e.g., cooling water, drinking water), gases (e.g., ventilation air), and power throughout the ship. The conduits 46 may be inside the structural walls 26*a* or the decks 24, as is usually the case with passenger vessels, or exposed in the ceilings, as is usually the case for military vessels. In the present approach, care is taken to position the conduits 46 so that they are not passed through the non-structural wall segments 26*b*. Thus, for example, no electrical outlets would normally be provided in the non-structural wall segments 26*b*. Instead, power and fluids would be provided to onboard apparatus 48 from outlets in the structural walls 26*a* or the decks 24. The onboard apparatus 48 would be attached to or supported from the decks 24 or to the structural walls 26*a*, but not attached to or supported from the non-structural wall segments 26*b*. However, in some cases light pieces of apparatus such as battery-powered clocks or small shelves could be attached to the non-structural wall segments 26*b*,to the extent that they do not interfere with the attachment and moving of the wall segments. The non-structural wall segments 26*b* may be provided with windows therethrough.

The basic panel structure of the non-structural wall segments 26*b* may be provided with added convenience features. As shown in FIG. 8, the panels of the non-structural wall segments 26*b* may be formed as two composite face sheets 50, such as described above, with a foam layer 52 sandwiched therebetween. The foam layer 52 provides thermal and acoustic insulation, and also damps shipboard vibration. Any of these constructions may be made quite light in weight, so that the reconfiguration process may be easily accomplished without the use of heavy lifting equipment.

The panels used in the non-structural wall segments are dielectric, and do not prevent radio communication between adjacent compartments. This feature is important if it is desired to be able to communicate between compartments using, for example, emergency rescue radios. By contrast, existing ship constructions with all-steel bulkheads require special radio systems for communication between interior compartments.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A ship, comprising:

a skeleton comprising a hull, a horizontally disposed deck permanently joined to the hull, and a plurality of vertically disposed structural support posts permanently joined to the deck, said posts supporting loads imposed from overlying decks, a plurality of non-structural wall segments, each of the non-structural wall segments comprising a plastic-containing material; and a plurality of attachments of the non-structural wall segments to the skeleton, at least some of the non-structural wall segments being attached directly to the support posts.

2. The ship of claim 1, wherein the skeleton is made of steel.

3. The ship of claim 1, wherein the skeleton further comprises:

a plurality of structural walls permanently attached to at least one of the deck and the structural support posts.

4. The ship of claim 1, wherein the ship further comprises:

a plurality of pieces of onboard apparatus affixed to the skeleton but not to the non-structural wall segments.

5. The ship of claim 1, further including:

a plurality of infrastructure elements affixed to the skeleton but not to the non-structural wall segments.

6. The ship of claim 1, wherein each of the plurality of non-structural wall segments comprises a composite material having reinforcing fibers embedded in the plastic.

7. The ship of claim 1, wherein each of the plurality of non-structural wall segments is semi-permanently attached to the skeleton.

8. The ship of claim 1, further including:

insulation affixed to each of the plurality of non-structural wall segments.

9. The ship of claim 1, wherein the attachments comprise:

fasteners extending between the non-structural wall segments and the support posts.

10. The ship of claim 1, wherein the attachments comprise:

tracks in the deck which receive the non-structural wall segments therein.

11. The ship of claim 1, further including a plurality of cover strips between adjacent non-structural wall segments.

12. A ship, comprising:

a steel skeleton comprising a hull, a horizontally disposed deck permanently joined to the hull, a plurality of vertically disposed structural support, posts permanently joined to the deck, said posts supporting loads imposed from overlying decks, a plurality of structural walls permanently attached to at least one of the deck and the structural support posts;

a plurality of non-structural wall segments, each of the non-structural wall segments comprising a composite material having reinforcing fibers embedded in a plastic; and a plurality of semi-permanent attachments of the non-structural wall segments to the skeleton, at least some of the non-structural wall segments being attached directly to the support posts.

13. The ship of claim 12, wherein the ship further comprises:

a plurality of pieces of onboard apparatus affixed to the skeleton but not to the non-structural wall segments.

14. The ship of claim 12, further including:

a plurality of infrastructure elements affixed to the skeleton but not to the non-structural wall segments.

15. The ship of claim 12, further including:

insulation affixed to each of the plurality of non-structural wall segments.

16. The ship of claim 12, wherein the attachments comprise:

fasteners extending between the non-structural wall segments and the support posts.

17. The ship of claim 12, wherein the attachments comprise:

tracks in the deck which receive the non-structural wall segments therein.

18. The ship of claim 12, further including a plurality of cover strips between adjacent non-structural wall segments.

19. The ship of claim 1, wherein each of the plurality of non-structural wall segments has a structure, throughout its entire thickness, of a composite material having reinforcing fibers embedded in the plastic.

20. The ship of claim 12, wherein each of the plurality of non-structural wall segments has a structure, throughout its entire thickness, of the composite material having the reinforcing fibers embedded in the plastic.

* * * * *